US006410873B1

(12) United States Patent
Chyla et al.

(10) Patent No.: US 6,410,873 B1
(45) Date of Patent: Jun. 25, 2002

(54) HIGH VOLTAGE CIRCUIT BREAKER, ESPECIALLY A GAS-BLAST CIRCUIT BREAKER

(75) Inventors: Thomas Chyla, Berlin; Peter Stenzel, Falkensee, both of (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/889,222

(22) PCT Filed: Jan. 14, 2000

(86) PCT No.: PCT/DE00/00175

§ 371 (c)(1),
(2), (4) Date: Jul. 13, 2001

(87) PCT Pub. No.: WO00/42627

PCT Pub. Date: Jul. 20, 2000

(30) Foreign Application Priority Data

Jan. 15, 1999 (DE) ..... 299 01 205 U

(51) Int. Cl.[7] ..... H01H 33/70
(52) U.S. Cl. ..... 218/78; 218/84; 218/154
(58) Field of Search ..... 218/78, 84, 154, 218/43, 45, 46, 47, 48–50, 53, 65, 67, 69, 83

(56) References Cited

U.S. PATENT DOCUMENTS 3,659,065 A * 4/1972 Roidt et al. ..... 218/60
5,578,806 A 11/1996 Hofbauer et al.
6,177,643 B1 1/2001 Marin et al.
6,271,494 B1 * 8/2001 Dienemann et al. ..... 218/48

FOREIGN PATENT DOCUMENTS

| | | |
|---|---|---|
| DE | 196 22 460 C2 | 11/1997 |
| DE | 197 02 822 C1 | 3/1998 |
| EP | 0 696 040 A1 | 2/1996 |
| EP | 0 809 269 A2 | 11/1997 |
| EP | 0809269 | 11/1997 |
| GB | 2 025 697 A | 1/1980 |
| WO | WO 98/32142 | 7/1998 |

* cited by examiner

*Primary Examiner*—Lincoln Donovan
*Assistant Examiner*—M. Fishman
(74) *Attorney, Agent, or Firm*—Morrison & Foerster, LLP

(57) ABSTRACT

In a high-voltage power breaker having two mutually opposite switching contacts which, when connected are surrounded by an insulating material nozzle, coaxially with respect to which a shielding electrode is arranged, with a first switching contact, which can be driven, being connected via the insulating material nozzle and a linkage to the second switching contact, such that said switching contact carries out a movement in the opposite direction to the first switching contact during operation of the latter, the shielding electrode is operatively connected to the second switching contact such that, during disconnection, it carries out a movement which controls the electric field in the switching gap.

7 Claims, 2 Drawing Sheets

HIGH VOLTAGE CIRCUIT BREAKER, ESPECIALLY A GAS-BLAST CIRCUIT BREAKER

CLAIM FOR PRIORITY

This application claims priority to International Application No. PCT/DE00/00175 which was published in the German language on Jul. 20, 2000.

The invention relates to a high-voltage power breaker, and in particular, to a gas-blast power breaker.

BACKGROUND OF THE INVENTION

A high-voltage power breaker is disclosed, for example, in DE 196 22 460 C2. In this high-voltage power breaker, the two mutually opposite switching contacts are surrounded by an insulating material nozzle when connected. The insulating material nozzle is connected to the first switching contact, which can be driven. The second switching contact is coupled by a linkage and a direction-changing lever to the insulating material nozzle such that, during operation of the first switching contact, the second switching contact carries out a movement in the opposite direction to it. In order to improve the field control in the interior of the high-voltage power breaker, the shielding electrode is arranged coaxially with respect to the insulating material nozzle. In order to increase the mutual movement during a switching operation, the shielding electrode is coupled to the direction-changing lever.

A transmission rod, which is rigidly connected to the insulating material nozzle, is used for coupling the insulating material nozzle to the direction-changing lever. Another transmission rod is used for driving the shielding electrode. Depending on the use of the direction-changing lever, these transmission rods are arranged eccentrically and on one side, which results in an asymmetric load on the insulating nozzle and shielding electrode. In addition to the desired optimum linear force transmission, forces occur which lead to tilting and tipping of the shielding electrode. Additional guide devices are required in order to ensure that the shielding electrode moves linearly. In order to allow the forces that occur in the process to be absorbed, the shielding electrode must be designed to be sufficiently mechanically robust. These mechanical requirements result in an increase in the moving masses, which is unnecessary per se from the electrical engineering point of view.

SUMMARY OF THE INVENTION

In one embodiment of the invention, there is a high-voltage power breaker, comprising: first and second mutually opposite switching contacts when connected, are surrounded by an insulating material nozzle coaxially with respect to which a shielding electrode is arranged, the second switching contact performing a movement in the opposite direction to the first switching contact, which can be driven, during operation of the first switching contact, and the shielding electrode controllable based on coupling by a linkage to the second switching contact, in the movement direction of the first switching contact at a speed whose magnitude is less than the speed of the first switching contact, wherein the insulating material nozzle is connected to two tie rods which are diametrically opposite one another with respect to the center axis of the switch, and extend parallel to the second switching contact and are firmly connected on the side facing away from the insulating material nozzle to a first holder, the first holder is arranged such that it can move axially and on which two connecting rods are arranged such that they can pivot, each of which is connected in an articulated manner to one limb of a fork, the fork is guided such that it can rotate in a fixed bearing and has a lever on its side essentially opposite the limbs, to which lever a coupling lever is connected such that it can pivot and is connected to the contact rod which is fit to the second switching contact and can move axially.

In one aspect of the invention, the angle $\alpha$ between the limbs of the fork and the lever is greater than 90.

In another aspect of the invention, another connecting rod mounted in an articulated manner on each limb of the fork, the connecting rods each connected such that they can pivot to a second holder, which is arranged on the first holder such that it can move axially, and on which two push rods are arranged in a fixed manner and are connected to the shielding electrode.

In still another aspect of the invention, in the central region of the limbs of the fork, the connecting rods are connected to the fork in an articulated manner such that, during disconnection, the distance traveled by the shielding electrode is shorter than that traveled by the second switching contact.

In yet another aspect of the invention, the fixed bearing which guides the fork such that it can rotate, is arranged on the outer circumference of a stationary tube guiding the contact rod, and at a distance from tube, and the coupling lever, which is connected to the lever of the fork such that it can pivot and is connected to the contact rod, is introduced into the stationary tube via an elongated hole within said stationary tube.

In another aspect of the invention, the fixed bearing which guides the fork such that it can rotate, is connected to the stationary tube.

In yet another aspect of the invention, the fixed bearing which guides the fork such that it can rotate is arranged on the end face of a stationary tube which guides the contact rod.

BRIEF DESCRIPTION OF THE INVENTION

The invention will be illustrated and explained in more detail with reference to an exemplary embodiment in the drawings.

DETAILED DESCRIPTION OF THE PREFERRED EMBODIMENTS

Figure 1:
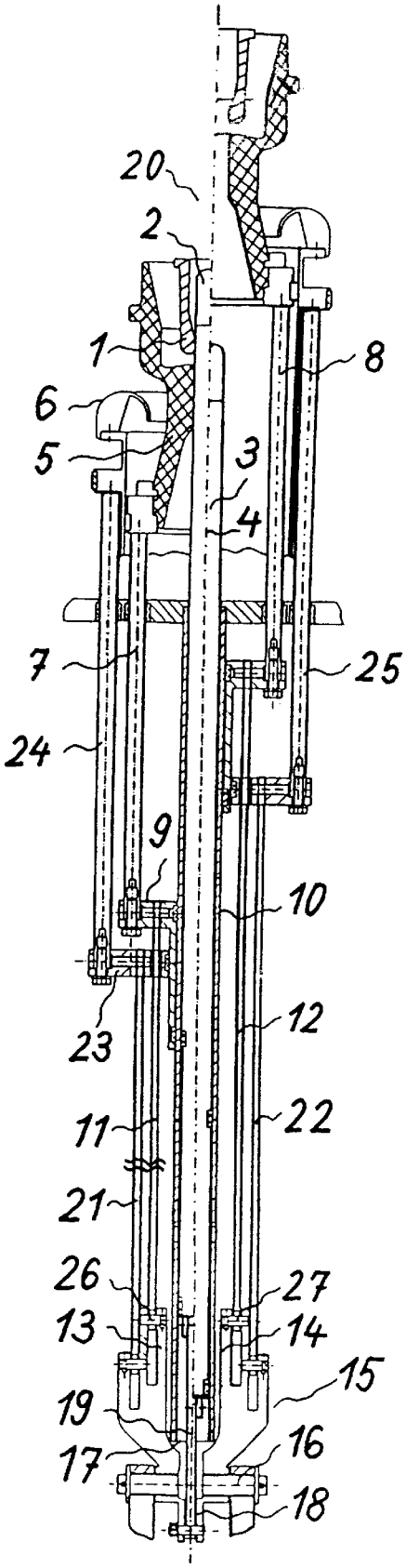
FIG. 1 shows a partial sectional view of a gas-blast power breaker.

The invention relates to a high-voltage power breaker, in particular a gas-blast power breaker, having two mutually opposite switching contacts which, when connected are surrounded by an insulating material nozzle coaxially with respect to which a shielding electrode is arranged, with the second switching contact carrying out a movement in the opposite direction to that of the first switching contact, which can be driven, during operation of the latter, and the shielding electrode being controllable on the basis of coupling by means of a linkage to the second switching contact, in the movement direction of the first switching contact at a speed whose magnitude is less than the speed of the first switching contact.

The present invention provides a high-voltage power breaker of the type mentioned initially whose moving parts have less mass to be accelerated.

An insulating material nozzle is connected to two tie rods which are diametrically opposite one another with respect to the center axis of the switch. They also extend parallel to the second switching contact and are firmly connected on the side facing away from the insulating material nozzle to a first holder which is arranged such that it can move axially and on which two connecting rods are arranged such that they can pivot. Each is connected in an articulated manner to one limb of a fork which is guided such that it can rotate in a fixed bearing and has a lever on its side essentially opposite the limbs, to which lever a coupling lever is connected such that it can pivot and is connected to the contact rod which is fit to the second switching contact and can move axially.

The angle $\alpha$ between the limbs of the fork and the lever to which the coupling lever is connected such that it can pivot should expediently be greater than 90°.

Hence, during disconnection, the contact rod which is fit with the second switching contact travels through a sufficiently long distance during its axial movement to ensure that an isolating gap which can be highly loaded, is formed between the switching contacts as a result of the mutual movement of the two switching contacts, which are opposite one another.

The coupling lever is connected to the contact rod, which is fit with the second switching contact, via a joint arranged on the contact rod. The joint may in this case be any configuration and which results in axial movement of the contact rod which is fit with the second switching contact, during pivoting of the coupling lever.

In an alternative embodiment of the invention, a movement, which controls the electric field in the switching gap, of the shielding electrode, which is arranged coaxially with respect to the insulating material nozzle but is not connected to the insulating material nozzle is achieved during an opposite movement of the second switching contact. This is carried out during disconnection, by mounting a further connecting rod in an articulated manner on each limb of the fork, which connecting rod is in each case connected such that it can pivot to a second holder. This is arranged on the first holder such as it can move axially, and on which two push rods are arranged in a fixed manner and are connected to the shielding electrode.

In this case, in the central region of the limbs of the fork, the connecting rods are connected to the fork in an articulated manner. During disconnection, the distance traveled by the shielding electrode, whose direction always corresponds to that of the first switching contact and the magnitude of whose speed is always in this case less than the speed of the first switching contact, is shorter than that traveled by the second switching contact. The connection of these connecting rods to the limbs of the fork, in its central region, at the same time satisfies preconditions. The preconditions are met such that the most suitable articulation point along the limbs of the fork for a movement of the shielding electrode, which provides optimum control of the electric field in the switching gap, can be selected for the articulated connection of these connecting rods to the limbs of the fork. This means that the use of further shields in the region of the switching gap can at least be reduced.

The invention can also operate independently of the arrangement of the fixed bearing which guides the fork such that it can rotate. Thus, according to one preferred embodiment, this can be arranged on the outer circumference of a stationary tube, which guides the contact rod, and on which the first holder is arranged such that it can move axially, and at a distance from it. With this arrangement of a fixed bearing, which can be connected to the stationary tube, the coupling lever, which is connected to the lever fork such that it can pivot and is connected to the contact rod, is advantageously introduced into the stationary tube via an elongated hole within said stationary tube. However, this does not prevent the coupling lever from also being inserted into the stationary the via its open end when the final bearing, which guides the fork such that it can rotate, is arrange on the outer circumference of the stationary tube.

It is preferable if the fixed bearing which guides the fork such that it can rotate is not arranged on the outer circumference of the stationary tube, but on its end face.

FIG. 1 shows a gas-blast power breaker in the region of two mutually opposite switching contacts, 1, 2, and the contact rod 3 which is fit with the second switching contact 2. While, to the left of the center axis 4, the gas-blast power breaker is illustrated in the connected position, with the exception of a few components in the lower region, the gas-blast power breaker is illustrated in the disconnection position on the right of the center axis 4.

As shown in FIG. 1, the two mutually opposite switching contacts 1, 2 are surrounded, when connected, by an insulating material nozzle 5, coaxially with respect to which a shielding electrode 6 is arranged. While the insulating material nozzle 5 is connected to the first switching contact 1 which can be driven, that is to say carries out the movement of the first switching contact 1, which can be driven, during a switching process, the shielding electrode 6 is not connected to the insulating material nozzle 5.

In order now to ensure that an isolating gap to which high dielectric loads can be applied is formed during disconnection when the second switching contact 2 carries out a movement in the opposite direction to the first switching contact 1, which can be driven, during operation of the latter, the insulating material nozzle 5 is connected to two tie rods 7, 8 which are diametrically opposite one another with respect to the center axis 4 and extend parallel to the contact rod 3. These tie rods 7, 8 are firmly connected to a holder 9 nozzle 5. This holder 9 is arranged such that it can move axially on a stationary tube by the contact rod 3, which is fit with the second switching contact 2, being arranged such that it can move axially. Furthermore, two connecting rods 11, 12, are arranged on the holder 9, which can move axially such that they can pivot, each of which is connected in an articulated manner to a limb 13, 14, of a fork 15, which is guided in a fixed bearing 16 such that it can rotate, which fixed bearing 16 is arranged on the end face 17 of the tube 10 which holds the contact rod 3 such that it can move axially. The fork 15, which is shown on both sides of the center axis 4, with the gas-blast power breaker in the disconnected position, has a lever 18 on its side opposite the limbs 13, 14, which lever 18 is connected, such that it can pivot, to a coupling lever 19, which is connected to the contact rod 3 which is fit with the second switching contact 2.

When disconnection takes place, the tie rods 7, 8 are driven via the insulating material nozzle 5 during operation of the first switching contact 1, which can be driven. Since the holder 9 moves axially on the stationary tube 10, at the same time that the tie rods 7, 8 are driven, the connecting rods 11, 12 which are arranged on the holder 9 such that they can pivot, are also driven. Assuming that each of the connecting rods 11, 12 is connected to a limb 13, 14 of the fork 15 which is guided in the fixed bearing 16 such that it can rotate, the fork 15 pivots in the fixed bearing 16. While the limbs 13, 14 of the fork 15 move in the direction of the holder 9, which can move axially, during this process, the lever 18, which is essentially opposite the limbs 13, 14, in this case moves in the opposite direction. However, this means that the coupling lever 19, which is connected to this lever 18 such that it can pivot, drives the contact rod 3, by axial movement within the stationary tube, and hence drives the second switching contact 2 so that the latter carries out a movement in the opposite direction from that of the first switching contact 1, which can be driven, during disconnection, thus forming an isolating gap which can be dielectrically highly loaded once the disconnection process has been completed.

In order now to achieve optimum control of the electric field in the switching gap 20 during a switching process in this gas-blast power breaker as well, a further respective connecting rod 21, 22 is mounted in an articulated manner on each limb 13, 14 of the fork 15 and is connected, such that it can pivot, to a second holder 23, which is arranged on the first holder 9 such that it can move axially. Two push rods 24, 25 are now arranged in a fixed manner on this second holder 23 and are connected to the shielding electrode 6 which is arranged coaxially with respect to the insulating material nozzle 5.

When the gas-blast power breaker carries out a disconnection process, the limbs 13, 14 of the fork 15 thus move the connecting rods 21, 22 and the push rods 24, 25 in the direction of the switching gap 20. Since the push rods 24, 25 are connected to the shielding electrode 6, the latter thus carries out a movement whose direction corresponds to that of the first switching contact 1. Since the connecting rods 21, 22, which are mounted in an articulated manner on the limbs 13, 14 of the fork 15, are mounted on the limbs 13, 14 in their central region, not only is the magnitude of the speed of the shielding electrode 6 less than that of the first switching contact 1, but also the distance traveled by the shielding electrode 6. The choice of the mounting point of the connecting rods 21, 22 on the limbs 13, 14 of the fork 15 between the fixed bearing 16 and the articulated mounting 26, 27 of the connecting rods 11, 12, thus provides the preconditions for the shielding electrode 6 to provide optimum control of the electric field in the switching gap 20 during the switching process.

Figure 2:
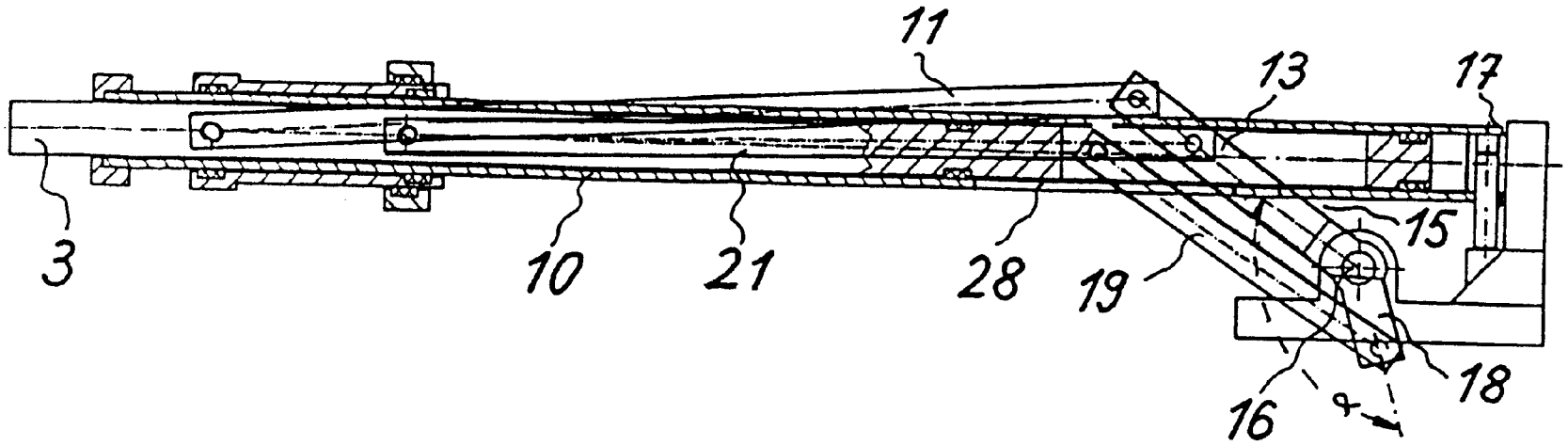
FIG. 2 shows a partial view of the gas-blast power breaker shown in FIG. 1, with a module arranged differently to the arrangement in FIG. 1.

While, according to FIG. 1, the fixed bearing 16 which guides the fork 15 such that it can rotate is arranged on the end face 17 of the stationary tube 10, this fixed bearing 16 in FIG. 2 is provided on the outer circumference of the stationary tube 10, which guides the contact rod 3. This is achieved in that, despite the necessity for the fork 15, there is no need to enlarge the switching chamber in the axial direction for the movement sequence of the second switching contact 2 and of the shielding electrode 6 (FIG. 1). In this case, the fixed bearing 16 which guides the fork 15 is arranged at a distance from the stationary tube 10, and is mounted on its end face 17. In this arrangement of the fixed bearing 16, the coupling lever 19, which is connected to the lever 18 of the fork 15 such as it can pivot and is connected to the contact rod 3, passes through the stationary tube 10, via an elongated hole 20 in it. Both the arrangement of the connecting rods, of which only the connecting rods 11 and 21 are illustrated here, and the configuration of the fork 15, of which only the limb 13 is illustrated here, correspond to the arrangement of the connecting rods 11, 12, 21, 22 and the configuration of the fork 15 with the two limbs 13, 14 shown in FIG. 1.

However, as can be seen from this figure, the angle $\alpha$ between the lever 18 and the limb 13 and hence the limb 14 (FIG. 1) of the fork 15, is greater than 90°, so that the contact rod 3 travels over a sufficiently large distance during disconnection in order to form an isolating gap which can be highly loaded between the switching contacts 1, 2 (FIG. 1).

What is claimed is:

1. A high-voltage power breaker, comprising: first and second mutually opposite switching contacts when connected, are surrounded by an insulating material nozzle coaxially with respect to which a shielding electrode is arranged, the second switching contact performing a movement in the opposite direction to the first switching contact, which can be driven, during operation of the first switching contact, and the shielding electrode controllable based on coupling by a linkage to the second switching contact, in the movement direction of the first switching contact at a speed whose magnitude is less than the speed of the first switching contact, wherein the insulating material nozzle is connected to two tie rods which are diametrically opposite one another with respect to the center axis of the switch, and extend parallel to the second switching contact and are firmly connected on the side facing away from the insulating material nozzle to a first holder, the first holder is arranged such that it can move axially and on which two connecting rods are arranged such that they can pivot, each of which is connected in an articulated manner to one limb of a fork, the fork is guided such that it can rotate in a fixed bearing and has a lever on its side essentially opposite the limbs, to which lever a coupling lever is connected such that it can pivot and is connected to the contact rod which is fit to the second switching contact and can move axially.

2. The high-voltage power breaker as claimed in claim 1, wherein the angle $\alpha$ between the limbs of the fork and the lever is greater than 90.

3. The high-voltage power breaker as claimed in claim 1, further comprising:

another connecting rod mounted in an articulated manner on each limb of the fork, the connecting rods each connected such that they can pivot to a second holder, which is arranged on the first holder such that it can move axially, and on which two push rods are arranged in a fixed manner and are connected to the shielding electrode.

4. The high-voltage power breaker as claimed in claim 3, wherein, in the central region of the limbs of the fork, the connecting rods are connected to the fork in an articulated manner such that, during disconnection, the distance traveled by the shielding electrode is shorter than that traveled by the second switching contact.

5. The high-voltage power breaker as claimed in claim 4, wherein, the fixed bearing which guides the fork such that it can rotate, is arranged on the outer circumference of a stationary tube guiding the contact rod, and at a distance from tube, and the coupling lever, which is connected to the lever of the fork such that it can pivot and is connected to the contact rod, is introduced into the stationary tube via an elongated hole within said stationary tube.

6. The high voltage power breaker as claimed in claim 5, wherein, the fixed bearing which guides the fork such that it can rotate, is connected to the stationary tube.

7. The high-voltage power breaker as claimed in claim 4, wherein, the fixed bearing which guides the fork such that it can rotate is arranged on the end face of a stationary tube which guides the contact rod.

* * * * *